United States Patent [19]

Osawa et al.

[11] 4,357,404

[45] Nov. 2, 1982

[54] PROCESS FOR FORMING A LITHOGRAPHIC PRINTING PLATE BY ELECTROPHOTOGRAPHY

[75] Inventors: Sadao Osawa; Seiichi Taguchi; Satoru Honjo, all of Asaka, Japan

[73] Assignee: Fuji Photo Film Co., Ltd., Minami-ashigara, Japan

[21] Appl. No.: 156,307

[22] Filed: Jun. 4, 1980

[30] Foreign Application Priority Data

Jun. 4, 1979 [JP] Japan ..... 54-69662

[51] Int. Cl.[3] ..... G03G 13/28; G03G 13/20

[52] U.S. Cl. ..... 430/49; 430/96; 430/87; 430/124; 430/302

[58] Field of Search ..... 430/49, 124, 302

[56] References Cited

U.S. PATENT DOCUMENTS

| | | | |
|---|---|---|---|
| 3,701,673 | 10/1972 | Hellar et al. | 430/124 |
| 3,853,552 | 12/1974 | Namika | 430/124 |
| 4,009,032 | 2/1977 | Schank | 430/49 |
| 4,077,325 | 3/1978 | Pacansky et al. | 430/49 |

*Primary Examiner*—John E. Kittle
*Assistant Examiner*—John L. Goodrow
*Attorney, Agent, or Firm*—Sughrue, Mion, Zinn, Macpeak and Seas

[57] ABSTRACT

A process for preparing a lithographic printing plate from an electrophotographic photosensitive material comprising a photoconductive insulating layer containing photoconductive zinc oxide and a thermoplastic insulating resin disposed on a waterproof support, said method comprising the steps of electrical charging, imagewise exposure, and development of the material in a wet developer having toner particles containing an oleophilic component dispersed in an insulating liquid carrier, thereby providing an oleophilic toner image, and heating the developed photosensitive material under such conditions that when an adhesive tape having a tackiness of 280 to 350 g/10 mm wide portion as measured by the 180° peeling method of JIS C2107 (passed once between pressure rollers at 50 mm/sec) and which has been contact-bonded to the surface of said toner image-bearing photosensitive material by passage between a metal roll and a rubber roll pressed against said roll at a pressure of 6000 g/cm$^2$, is peeled off said photosensitive material one minute after the contact-bonding at a peeling rate of 500 mm/min and an angle of 180 degrees, the toner image carried away by adhering to the tape is not more than 30 wt. % of the toner in the solid image area on which at least 0.03 mg/cm$^2$ of the toner is deposited, and the cohesion of toner particles inside the toner layer against the peeling force is at least about 350 g/10 mm wide portion.

18 Claims, 9 Drawing Figures

(150th PRINT)

(1,250th PRINT)

(2,000th PRINT)

(150 th PRINT)

(5,000 th PRINT)

(8,000 th PRINT)

PROCESS FOR FORMING A LITHOGRAPHIC PRINTING PLATE BY ELECTROPHOTOGRAPHY

BACKGROUND OF THE INVENTION

1. Field of the Invention

This invention relates to a process for forming a lithographic printing plate by electrophotography and, more particularly, to a process for preparing electrophotographically a lithographic printing plate of high quality and long press-life using the wet developing method.

2. Description of the Prior Art

The traditional photomechanical process comprises recording a desired image from an original onto a photographic lith film by an enlarging exposure, subjecting the photosensitive material to contact exposure to provide an exposed image on a printing plate having a photosensitive layer thereon that contains a diazonium compound, and developing the thus-exposed image. However, recently, with respect to "line subjects" (that is, characters and screened images comprising fine lines) a method of providing an exposed image on a printing plate directly from an original by an enlarging exposure gains acceptance. The new method requires a high-sensitivity precursor capable of an enlarging exposure. This requirement can be met by either a precursor plate using a silver salt photosensitive material of the diffusion transfer type, or a precursor plate using an electrophotographic material as described in British Pat. No. 1,465,926, French Pat. No. 1,266,748 and U.S. Pat. Nos. 2,988,988 and 2,952,536. The former is expensive and is used for high-standard printing because the printing plate prepared from such a precursor plate withstands the printing of several thousand reproductions and the quality of the resulting image is good. The latter provides an image of poor quality in a dry development system, and if it is processed by a wet development system, the resulting printing plate has a low press-life. No matter which processing system is used, this latter type of precursor plate, taking advantage of its economy and ease of processing, is employed in printing where reproduction of lower image quality than with the former precursor is permissible.

SUMMARY OF THE INVENTION

Therefore, one object of this invention is to provide an improved process for forming a lithographic printing plate by electrophotography using a wet developing system.

Another object of this invention is to provide a method of producing an electrophotographic lithographic printing plate having a remarkably higher press-life than is realized by conventional printing plates.

Still another object of this invention is to improve the image quality in a reproduction provided from an electrophotographic lithographic printing plate, and especially, to provide a method of producing an electrophotographic lithographic printing plate capable of providing a set of reproductions of substantially constant image quality throughout the printing operation.

A further object of this invention is to provide a method for obtaining from an electrophotographic lithographic printing plate a lithographic reproduction having the high image quality that has been attainable only from a PS plate (pre-sensitized printing plate).

Yet another object of this invention is to provide a method of producing an electrophotographic lithographic printing plate that can be handled with ease on a printing machine due to the greater difference in hydrophilicity or oleophilicity between the image area and non-image area, as compared with the conventional printing plate.

These objects of this invention can be achieved by a process for preparing a lithographic printing plate from an electrophotographic photosensitive material comprising a photoconductive insulating layer containing photoconductive zinc oxide and a thermoplastic insulating resin disposed on a waterproof support, said method comprising the steps of electrical charging, imagewise exposure, and development of the material in a wet developer having toner particles containing an oleophilic component dispersed in an insulating liquid carrier, thereby providing an oleophilic toner image, and heating the developed photosensitive material under conditions such that when an adhesive tape, having a tackiness of 280 to 350 g/10 mm wide portion, as measured by the 180° peeling method of JIS C2107 (passed once between pressure rollers at 50 mm/sec) (the year of the version: 1975) and which has been contact-bonded to the surface of said toner image-bearing photosensitive material at ordinary temperatures (20° C.±2) by passage between a metal roll and a rubber roll pressed against said roll at a pressure of 6,000 g/cm$^2$, is peeled off said photosensitive material one minute after the contact-bonding at a peeling rate of 500 mm/min and an angle of 180°, the toner image adhered to the tape is not more than 30 wt % of the toner in the solid image area on which at least 0.03 mg/cm$^2$ of the toner is deposited, and the cohesion of toner particles inside the toner layer against the peeling force is at least about 350 g/10 mm wide portion.

DETAILED DESCRIPTION OF THE INVENTION

Figure 1:
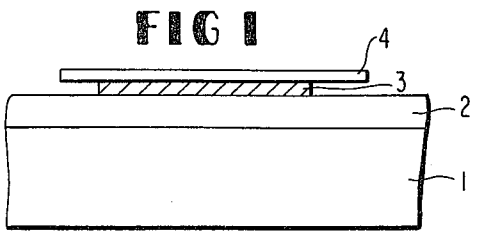
FIG. 1 is a schematic longitudinal sectional view showing the method of the experiment conducted according to this invention.

To devise a photomechanical process that uses an electrophotographic material and yet provides a high-quality image and a printing plate having a longer press-life, the behavior shown by the photosensitive material during the plate-making step and the printing step have been analyzed, and the following facts have been found. The toner image formed on a photosensitive layer by a wet developing system exhibits sufficiently high resolution and high edge sharpness with little tendency of line broadening or thinning. If the photosensitive layer has a uniform thickness and composition, the toner image obtained is not inferior to that obtained by the silver salt diffusion transfer process. When the plate has the non-image area which has been rendered hydrophilic by a conventional method and set on a printing machine for continuous printing, it provides, in the initial stage of printing, reproductions having an image comparable to that obtained by the silver salt diffusion transfer process. However, the press-life of the plate is very short, and it is observed that the greater the number of reproductions, the poorer the image quality obtained becomes, and after printing more than 1,000 reproductions, the quality of the image obtained is no longer high.

Based on these findings, closer comparative observation of the details of the reproductions have been made and it has been found that the primary cause of short press-life is that the printing image that is rapidly impaired during the printing operation until it is no longer ink-receptive. We have also found that the phenomenon is correlated with damping water that is supplied during printing to keep the non-image area hydrophilic. As is already known well in the art, the hydrophilically treated layer of zinc oxide gradually becomes less hydrophilic in the course of repeated printing operations, and the decrease in hydrophilicity is compensated for by supplying damping water than contains an etching component capable of converting the surface of said layer into a hydrophilic surface. If the etching effect of the damping water is weak, the injury to the image area is suppressed but then, the non-image area unavoidably becomes ink-receptive to give a stained reproduction. On the other hand, damping water having the desired etching effect impairs the image area and the resulting plate does not have an adequately long press-life. It is interesting to note that with respect to printing performed under the printing conditions and requirements for the etching effect of damping water that are empirically employed in the printing market and which are believed to provide a relatively high image quality and the longest press-life; it is observed that a printing plate used to print more than 1,000 reproductions is characterized by apparent breaks in the image area, especially the development of many defects in a halftone area, and fails to provide a satisfactory reproduction.

Based on such observations, according to the instant invention it has now been found that by increasing the strength of the image area of a lithographic printing plate prepared by the wet process, the press-life of the plate can be extended, thus providing a larger number of high-quality reproductions.

The electrophotographic photosensitive material to be used in this invention is described as follows.

The electrophotographic photosensitive material to be used in this invention consists of a waterproof support and a photoconductive insulating layer. Typical examples of the waterproof support include metal plates such as aluminum and zinc as well as paper rendered electrically conductive, and it is desired that the surface of the support on which a photosensitive layer is to be disposed have a suitable degree of electrical conductivity. Therefore, plastics, paper and the like overlaid with an electrically conductive surface layer, such as a conductive resin layer, a layer of evaporated metal, a layer of conductive metal compound, and a layer comprising a conductive pigment such as carbon and a binder may be advantageously used. If the support is paper, provision of a conductive subbing layer on both sides of the support is desired for improved electrical characteristics and curl balance, and such layer should be waterproof. Techniques related to preparation of supports including the preparation of a waterproof conductive layer are disclosed in references as exemplified below, and the teachings disclosed therein are advantageously applicable to the electrophotographic photosensitive material of this invention: Japanese Patent Publication Nos. 18595/72, 7457/73, 18325/73, Japanese Patent Application (OPI) Nos. 99406/73, 17241/74 (the term "OPI" as used herein refers to a "published unexamined Japanese patent application"), Japanese Patent Publication No. 13020/76, Japanese Patent Application (OPI) Nos. 32701/77, 4601/78 and 78503/77, Japanese Patent Publication Nos. 4111/72, 9608/70, U.S. Pat. No. 3,672,888, Japanese Utility Model Application (OPI) No. 5538/77, and Japanese Patent Application (OPI) No. 4239/77, and Japanese Patent Publication Nos. 11902/73, 11898/73 and 11900/73.

Particularly preferred techniques are those which use water-insoluble conductive materials, and the use of colloidal alumina or the like is very much preferred (see, for example, Japanese Patent Publication Nos. 3846/74 and 45549/72).

The photoconductive insulating layer comprises a zinc oxide powder (hereunder referred to as ZnO) prepared by the French process, i.e., burning zinc metal in air, and a binder resin consisting mainly of a thermoplastic resin.

A great number of thermoplastic resins can be used as the binder, and those resistant to the attack of the liquid carrier for wet developer, and particularly those mainly composed of an acrylic ester, are preferred. Illustrative thermoplastic binders are disclosed in the following patent and other technical literature: Japanese Patent Publication Nos. 18497/73, 32735/73, 31011/75, 34183/73, 43829/73, 37861/74, 36769/75, 13355/74, Japanese Patent Application (OPI) No. 8554/73, Japanese Patent Publication No. 49212/76, Japanese Patent Application (OPI) No. 8557/73, U.S. Pat. No. 3,885,961, Japanese Patent Application (OPI) Nos. 51329/75 and 140135/75, U.S. Pat. Nos. 3,709,684, 3,745,006, British Pat. No. 1,326,748, Japanese Patent Publication No. 17355/73, Japanese Patent Application (OPI) Nos. 70023/75, 11137/74, 71235/73, Japanese Patent Publication Nos. 16148/76, 17354/73, Japanese Patent Application (OPI) No. 42733/77, Japanese Patent Publication No. 32383/73, and Japanese Patent Application (OPI) No. 109039/74, and technical references such as R. W. McNamee & A. E. Schiavona, *Tappi*, 49 (12) 111A-113A (1966), Kenkichi Muto, Takashi Notake, Masafumi Ota, *Ricoh Technical Review*, 1 (1), pp. 40–44 (1971), and E. S. Baltazzi et al., *Phot. Sci. & Eng.*, 16 [S] pp. 354–358 (1972).

The binder may be used in a form such that can be diluted with water, or it may be so formulated that it is an aqueous emulsion or aqueous alkali solution. Techniques for preparing such binders are described in the following patent literature: British Pat. No. 1,230,108, Japanese Patent Publication Nos. 40913/71, 40916/71, West German Patent Publication (DAS) No. 1,815,472, and Japanese Patent Publication Nos. 18676/67 and 27438/71.

Of the binder formulations described above, particularly preferred are those which at least partially soften to flow at the temperature used in the subsequent heat treatment and which provide a coating that is strong enough to withstand the mechanical action of printing. The first condition can be met by a thermoplastic resin that is capable of softening at higher than 100° to 120°

C., and particularly all binders incorporated in the ZnO sensitive materials currently available on the market meet this condition. On the other hand, the second condition excludes resins having excessively low secondary transition points, and requires a molecular weight higher than those of office copying papers. Specifically, resins having a second-order transition point of from about 10° to 80° C., and especially from 20° to 70° C., and a molecular weight of from several thousand to fifty thousand, are preferred. Those having too low a secondary transition point provide a layer that tends to cause blocking (i.e., to adhere strongly the surface of the electrophotographic photosensitive material and the back surface of another superimposed thereon) when finished to have a high degree of smoothness, and those having too high a secondary transition point form a brittle layer. If two resins are used as a mixture, it is desirable that Tg, defined by the expression $(1/Tg)=(W_1/Tg_1)+(W_2/Tg_2)$, fall within the above specified range of secondary transition points (in the expression, W is the weight percentage of each resin component, and Tg is its second-order transition point).

Binders that contain thermosetting resins can be advantageously used in this invention so long as they soften to some extent upon heating. Illustrative such thermosetting resins include alkyd, epoxy, thermosetting acrylic resins, epoxy ester resins, and silicone. These resins desirably constitute up to about 20% of the total binder. Even a binder composed entirely of a thermosetting resin may be advantageously used in this invention if it remains uncrosslinked until the heat treatment to be described in detail hereafter.

The ratio by weight of ZnO to binder resin is from about 3:1 to 20:1, and desirably is from about 4:1 to 8:1. As is further described below, the thermoplastic resin component desirably comprises at least 8 wt % of the photosensitive layer, in order to provide a toner image that satisfactorily withstands multiple printings.

The photoconductive insulating layer may also contain a pigment other than ZnO, such as $TiO_2$, calcium carbonate, kaolin, or clay.

It is possible to sensitize ZnO with a dye sensitizer. If dye sensitization is to be carried out, it is preferred that the photoconductive insulating layer not contain a polymerization initiator or other materials that may destroy the dye. Other optional additives include metal salts, metal soaps, plasticizers and surfactants that control the light exhaustion characteristics of the photoconductive insulating layer. Preferably, these additives do not dissolve in a wet developer.

To provide a waterproof support with the coating of a photoconductive insulating layer using the ZnO and binder described above, said ZnO and binder are first kneaded with other additives in the presence of an aqueous or organic solvent. In this invention, it is desired that the surface of the resulting photosensitive material not contain a great number of coarse agglomerates of pigment, and that the quality of the image obtained at the start of lithography be as high as possible. To satisfy these requirement, proper conditions must be selected for kneading operation. While any known kneading machine such as ball mill, attritor, colloid mill or sand grind mill may be used, the number of impacts applied is desirably large enough to prevent mechanically introducing a lattice defect into the crystal of a ZnO photoconductor but the force of impact applied should be as small as possible. One desirable method includes a pretreatment wherein the surface of the ZnO is wet with methanol or the like, to provide easy kneading (see Japanese Patent Publication Nos. 13516/68 and 13028/74). Another effective method provides maximum surface roughness by using two kinds of ZnO having greatly differing grain size distribution curves (see U.S. Pat. No. 3,723,115). Alternatively, the pigment component before kneading can either be placed under vacuum or adequately evacuated under reduced pressure to promote wetting with a resin solution to be introduced into the resulting powder layer. One thing to be noted is that covering the ZnO crystal completely with the resin results in poor photoconductivity and a longer hydrophilic conversion period. This is another reason why the techniques described in the afore-cited Japanese Patent Publication Nos. 13516/68, 13028/74 and U.S. Pat. No. 3,723,115 are considered effective in this invention. Dye sensitizer and other optional additivies may be added prior to kneading, but they are desirably added just before the resulting photoconductive layer is applied to the support.

The thus-prepared photoconductive composition can be applied to the waterproof support by many techniques known in the art. Typical examples are reverse roll coating, blade coating, dip coating and wire bar coating. Typical coating solvents are organic solvents such as toluene, xylene, and butyl acetate, and the resulting coating solution is diluted to a suitable degree prior to application. The coating thickness after drying is in the range of from about 5 to 20 microns, and preferably is from 6 to 12 microns. The method of this invention provides adequately long press-life even when only a small amount of toner is used; accordingly, the surface electrical potential of the photosensitive layer can be held low, and this means that a thin photosensitive layer may be advantageously used in practical operation.

For the purpose of hydrophilic conversion, the surface of the photosensitive insulating layer is required to have a high concentration of ZnO where it corresponds to the non-image area of the resulting printing plate. To meet this requirement, the photoconductive insulating layer may be composed of a dual structure wherein a photoconductive layer that contains ZnO in a small amount but which is mechanically strong enough to assure intimate contact with the support is disposed on the support side and a surface layer containing both the thermoplastic resin and ZnO, the latter being in at least four times as much as the weight of the former, is superimposed on said photoconductive layer. Such dual structure is essential if the support is made of a special material and the desired press-life is such that more than 50,000 reproductions can be provided.

Further, the limitations described below dictate that the surface of the photoconductive insulating layer be such that it is desirably devoid of sharp and minute protrusions about 40 microns in diameter or that it contains not more than fifty such protrusions per square centimeter. The image quality required with a lithographic printing plate of the type contemplated by this invention is generally such that it can provide a sharp reproduction of as small as a 9-degree (9/14 mm by square) Ming-style type for photo-composition. A type of this size can contain a horizontal line as thin as about 55 to 65 microns. Because of the manufacturing process and other limitations, a ZnO-containing photosensitive layer can often have many aggregated particles of ZnO remaining on the surface, and most commercial products typically have protrusions 40 microns or more in diameter in a frequency of about several hundred to a thousand per square centimeter. If such photosensitive material is used to reproduce a light type face specified above, there is a great possibility that even an original equal in size to the type is unable to prevent the formation of a broken horizontal line or an indistinct nonlinear edge. As a result, the image quality obtained is appreciably lower than that obtained from a silver salt photosensitive material. Accordingly, the surface of the photoconductive insulating layer of this invention is desirably free of sharp and minute protrusions larger than 40 microns in diameter, or it preferably contains not more than fifty of such protrusions per square centimeter. In addition, for meeting such requirements as the prevention of sticking of printing paper during printing, the photoconductive insulating layer desirably has a high density of fine and uniform protrusions on the surface.

The thus-prepared electrophotographic photosensitive material is dried, electrically charged in a dark place, subjected to imagewise exposure, and processed with a wet developer to form a toner image. Electric charging is generally done by negative corona charging, and the support may either be connected to earth (i.e., grounded), or double corona charging may be employed. Either a reflective or transmitting original, and either a positive or negative original may be used for imagewise exposure. When a negatively charged layer is exposed from a positive image, a wet developer containing positivey charged toner particles is used, and when said layer is exposed from a negative image, a wet developer containing negatively charged toner particles is used.

The wet developer comprises a liquid carrier of high insulating property and low dielectric constant which has toner particles imparting an oleophilic toner image dispersed therein. Because of their low toxicity, low dissolving power and high insulating property, isoparaffin hydrocarbons are typically used as the liquid carrier. Generally, a liquid insulator having a volume resistivity of at least $10^9$ ohms:centimeter, and a dielectric constant of not more than 3.0, is used as liquid carrier. The liquid carrier may contain a charge regulator, and a dispersion stabilizing resin or the like in the form of a solution or an organosol, but such additives should not be used in so great an amount that the volume resistivity of the resulting developer is lower than $10^{11}$ to $10^{12}$ ohms:centimeter.

In an extreme case, the toner particles to be used in this invention may not contain any coloring material, and instead they may consist of only film-forming and oleophilic components. In practice, a coloring component is desirably incorporated because it offers the advantage of realizing visual checking of an image formed on the photoconductive insulating layer, and it is particularly desired that at least part of the coloring component is oleophilic, too. Illustrative such coloring components are described in the following patent literature: Japanese Patent Publication Nos. 43440/71, 6154/71, 40347/75, British Patent 1,215,554, Japanese Patent Publication Nos. 28233/76 and 28234/76.

In view of printing techniques, it is naturally expected that use of toner particles composed of a highly oleophilic resin component as a main component provides an image having long press-life, and wet developers for the photomechanical process have mostly been designed in this course. One approach is that a resin component is deposited or absorbed on finely crushed particles in an appropriate manner based on a finely-crushing technique for coloring materials such as pigments, as described in, for example, Japanese Patent Publication No. 32351/74. This process is, however, limited in resin composition since the process relies on a mechanical and chemical effect during kneading and requires much time to regulate developers. In general, resin components as used in such process must possess affinity to the liquid carrier, and are selected from resins substantially soluble or slightly white-turbiding in the liquid carrier in practical aspect. The latter resins are described in Japanese Patent Application (OPI) No. 126336/74. However, it is experimentally confirmed that such resins are not contained in a large amount at image areas after development so that long press-life cannot be realized. On the other hand, use of resins insoluble in the liquid carrier to compose toner particles is not compatible with the so-called "pigment-crushing technique" as described above. In order to avoid the difficulties, carbon having graft polymer chain at surface (so-called graft carbon) has been employed as toner particles, or particles composed of a mixture of resins and pigments have been prepared by dry crushing, followed by wet crushing. However, the former graft carbon is limited in resin content, and the latter is uneconomical because it needs complicate procedures and in addition resins having low transition points cannot be used in the latter.

Accordingly, resins having high affinity to the liquid carrier cannot be contained in a large amount at image areas, and even if images are formed using such toner particles the images have poor cohesive force so that high press-life cannot be realized. On the other hand, resins insoluble in the liquid carrier are thermally hard, resulting in poor press-life.

However, according to the present invention, an excellent press-life can be attained even using such toner particles as described above, and in particular, the present invention is effective when a developer with little resin components (particularly film-forming resin components) is used. In other word, even when the toner particles at the image area contain only 0.1% by weight or less of the film-forming resin component, an excellent printing plate can be obtained in the present invention, as is clear from Example 1.

A particularly preferred developer used in the present invention that is capable of forming such an oleophilic toner image contains a resin component typified by cyclized rubber, styrene-butadiene copolymer or derivatives thereof. Techniques for use of the developer are described in the following patent literature: Japanese Patent Publication No. 32351/74, Japanese Patent Application (OPI) No. 126336/74, Japanese Patent Publication No. 25666/73, U.S. Pat. Nos. 3,714,048, 3,907,693, Japanese Patent Application (OPI) Nos. 13246/76, 22138/74, Japanese Patent Publication Nos. 26594/74, 26595/74, 26596/74, Japanese Patent Application (OPI) Nos. 89428/76, 98634/74, 24738/73, 24739/73, 24740/73, 22038/73, 22039/73, 98240/74, 98241/74, 75440/75, 5032/74, 101137/73, 93344/73, 95840/73, 95841/73, 95842/73, U.S. Pat. No. 3,657,130, British Pat. No. 1,352,067, and Japanese Patent Application (OPI) No. 116047/75.

The liquid developer may be considered to comprise a pigment covered with a resin component having within the same molecule a portion having strong affinity to the liquid carrier. Alternatively, a slight portion of a functional, polarity-controlling group may be introduced into the resin component which is then dispersed in the liquid carrier to form an organosol. Such organosol may further contain a small amount of a charge-regulating component that is soluble in the carrier. In many cases, the liquid developer contains a carrier-soluble resin for providing a stable dispersion of toner particles, and the resin in most cases is uniformly deposited or adsorbed on the developed photoconductive layer. But the deposited or adsorbed resin component seldom inhibits the subsequent hydrophilic conversion of the photoconductive layer (i.e., treatment to render the photoconductive layer hydrophilic), and so, there is no need to be particularly careful about the composition of the wet developer.

The toner included in the liquid developer comprises particles that generally are of submicron size, and this particle size is in no way deleterious to the resolvability required for a reproduction, that is, the ability to provide a high-fidelity reproduction of the resulting printing image. A more important factor in determination of resolvability is the mechanical uniformity of the surface of the photoconductive insulating layer. Therefore, all sizes of toner particles used in conventional liquid developers may be chosen with advantage as the size of the toner particles in the liquid developer to be used in this invention. The resolvability required for electrophotographic plate making of the type contemplated by this invention is no more than 20 paired lines/mm, and a toner particle having a size of up to about 1 to 2 μm is tolerable for this purpose. Since reasonably large particles are advatageous for providing a toner image of long press-life, uniform particles of a size of about 0.5 μm are particularly preferred.

The polarity of the toner in the developer can be rendered either positive or negative, primarily by varying the type of a polar group in the toner or the type of charge regulator used. Since the ZnO photoconductive insulating layer of this invention usually provides a latent image of negative polarity, a toner of positive polarity gives reproduction characteristics of positive-positive mode, and a toner of negative polarity gives reproduction characteristics of negative-positive mode. Any known charge regulator can be used in this invention with advantage. Typical charge regulators are described in the same patent literature cited above that disclose techniques related to developers, and well known examples include metal soaps, Nigrosine, the reaction product of Nigrosine and long-chain aliphatic acid, surfactants having the structure of quaternary ammonium salt, and organic compounds having a sulfonic group.

Any known method can be used for development of the latent image with a liquid developer. Development electrodes are desirably used for shortened development or high-fidelity reproduction of a solid black area or halftone image. According to this invention, a slight stream or fog in the toner image at a density lower than a certain value will not be reproduced faithfully on printed matter after hydrophilic conversion of the non-image area. Therefore, the care to be taken need not be so scrupulous as when the developed toner image alone is used to provide a final print. Therefore, a very wide variety of developing methods can be used in this invention. As a further advantage, so long as the density of the center of a solid black area exceeds a certain threshold, the development operation may be terminated even if it is not equal to the density of the periphery (edge portion).

The so developed electrophotographic photosensitive material which has formed an oleophilic toner image on the photoconductive insulating layer is optionally squeegeed or rinsed with a substantially toner-free insulating fluid, dried with hot air or the like to let the volatile liquid carrier evaporate, and optionally retouched before it is subjected to the subsequent operation for making a printing plate.

In the conventional process for forming a lithographic printing plate by electrophotography, the photosensitive material that has gone through the drying step and optional retouching step is subjected to optional hydrophilic conversion of the non-image area, and is immediately set on a printing machine for printing. It is observed the image area of the printing plate prepared through the steps of the conventional process is so weak that it can be used for only about 1,000 reproductions before the image area is impaired. Therefore, we conducted experiments in an attempt to provide a stronger image area, and have found that a printing plate of remarkably long press-life can be prepared by holding the electrophotographic photosensitive material with an olephilic toner image at an elevated temperature satisfying a given heating condition.

The heating condition to be used in this invention is such that, when an adhesive tape having a standard degree of tackness of 280 to 350 g/10 mm wide portion as measured by the 180° peeling method of JIS C2017 (passed once between pressure rollers at 50 mm/sec) and which has been contact-bonded to the surface of a toner-image bearing electrophotographic photosensitive material, with at least 0.03 mg of toner deposited per square centimeter of a solid image area, at a pressure of 6,000 g/cm$^2$, is peeled off said photosensitive material one minute after the contact-bonding at a peeling rate of 500 mm/min and an angle of 180°, the toner image carried away by adhering to the tape is no more than 30 wt %, preferably no more than 20 wt %, of that in the solid image area, and the cohesion of toner particles inside the toner layer against the peeling force is at least about 350 g/10 mm wide portion, and preferably is at least about 400 g/10 mm wide portion. It is to be noted that in order to eliminate a fire hazard due to the liquid carried, which is often inflammable, the heat treatment under this condition is desirably preceded by letting the greater part of the carrier evaporate at a temperature of about 80° C.

The mechanism whereby a great increase in the press-life of printing plate results from the heating under the conditions specified above has not been definitely established. However, based on observations, it is believed that the mechanism might be explained as follows.

FIG. 1 is a schematic representation of an electrophotographic photosensitive material comprising a support 1 and a photoconductive insulating layer 2 which has a toner layer 3 formed thereon. If an adhesive tape 4 is contact-bonded to and peeled from the toner layer 3, the parameter of the peeling may be determined by following three forces at the interface or break plane; viz., the bonding strength at the interface between tape and toner layer (Fs), the cohesion of toner particles inside the toner layer (Ft), and the bonding strength the interface between toner layer and photosensitive layer (Fb).

When various conventional printing plates were subjected to the peeling test defined above, printing plates of the poorest quality had the ZnO photosensitive layer itself transferred onto the adhesive tape. Such plate is out of the question, because the photosensitive layer per se is defective. The other plates had more than 50% of toner carried away by adhering to the tape when it was peeled off the toner layer with a peeling force of about 150 to 200 g/10 mm wide portion. Accordingly, no conventional technique could provide an electrophotographic photosensitive material having a toner image resistant to a peeling force of 350 g/10 mm wide portion as specified in this invention.

When a master of the type described above was heated for more than several minutes at a temperature of at least 120° C., preferably at least 150° C., the amount of the toner transferred onto the tape decreased slowly as long as the heating condition was weak, and the force required for peeling the tape from the toner layer increased correspondingly. After such change, the tape began to peel right from the surface of the toner layer, whereupon the force necessary for peeling decreased. It is believed that when the tape peels just from the surface of the toner layer, Ft has increased to such a level that the relation of $Ft > Fs$ is satisfied. Empirically, it has been found that, if the peeling force required exceeds the value of 350 g/10 mm wide portion, or even when the force required for causing the tape to peel right from the surface of the toner layer (without any toner transfer onto the tape) is less than 350 g/10 mm wide portion, if the force required for peeling with the slightest amount of toner adhering to the tape after heating under the condition a little weaker than that causing the tape to peel right from the surface of the toner layer is more than 350 g/10 mm wide portion, in other words, if that value is exceeded by Ft, the cohesion of toner particles inside the toner layer as occurring in the tape test specified in this invention, the resulting printing plate image exhibits remarkable strength, providing more than 5,000 reproductions without causing any change in the image quality throughout the printing operation.

The above discussion is based on the macroscopic average of each of the three factors (e.g., internal cohesion), and close observation of the actual state of peeling indicates that when the thickness of the toner layer is small, a break plane always develops in the neighborhood of the photosensitive layer, and generally speaking, the amount of toner transferred onto the tape decreases with the intensity of the heating. It is therefore believed that heating has the effect not only of increasing the cohesion of toner particles inside the toner layer (Ft) but also it results in appreciable increase in the bonding strength at the interface between toner layer and photosensitive layer (Fb).

It was also observed that when a toner image which had the potential to be given remarkably long press-life by heating (about 30,000 reproductions of a 150-line halftone image after heating at 150° C. for 10 minutes) was electrically transferred to an aluminum substrate for a PS plate (with the surface anodized and grained brushing), and heated under similar conditions, the resulting printing plate had only a very short press-life (providing no more than 100 reproductions). This indicates that the improvement in press-life achieved by heating in this invention has for its basis the increase in the cohesion of toner particles in the toner layer (Ft) as well as the increase in the bonding strength between the toner layer and ZnO photosensitive layer (Fb) resulting from the softening of the resin binder in said photosensitive layer. Therefore, the heating effected in this invention should be clearly distinguished from "burning", a known technique used in preparing conventional printing plates, such as PS plates.

In view of the composition of the wet toner, the increase in the cohesion of toner particles inside the toner layer (Ft) may appear incredible, but in fact, a trace amount of the volatile component remaining in the toner layer may have contributed to a considerable loss in the strength of the toner image. This assumption also derives from the fact that heating at 90° C. for one day did not realize any appreciable improvement in press-life and that a heating temperature of at least 120° C. was necessary for achieving the intended effect. In another test, the image obtained using a high-boiling liquid carrier, such as Isopar H, was rinsed with a highly volatile solvent such as Isopar E, and left to stand either at ordinary temperatures or at about 90° C. for an extended period of time. No increase in press-life resulted. This seems to indicate that the amount or concentration of the volatile component involved was very small. Another factor to be considered is that the resin in the toner that has swollen in the liquid carrier will never have adequate mechanical strength simply by letting the carrier evaporate from the developer system, and this observation seems to be true also if the resin has a considerably low second-order transition point.

Figure 2:
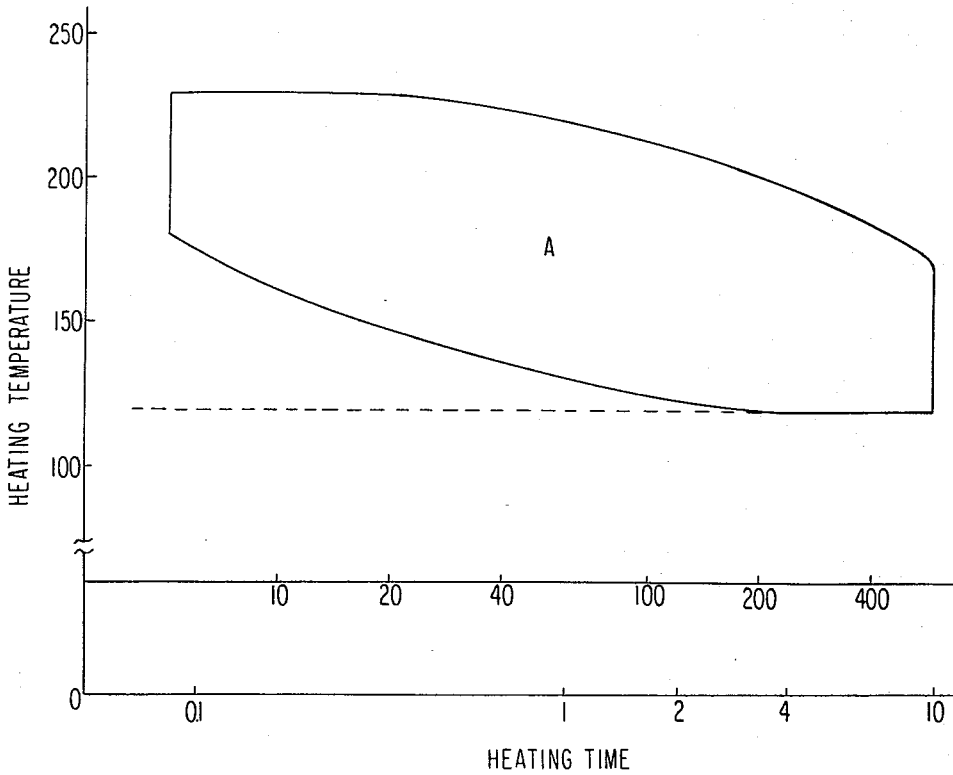
FIG. 2 is a graph showing one example of the heating condition to be employed in this invention.

The desired heating conditions cannot be defined in simple terms, and the results obtained with a heating temperature held constant are shown in FIG. 2. The heating conditions on or surrounded by the line in FIG. 2 can increase the press-life to more than about 3,000. In other words, preferred heating conditions in the present invention are, e.g., at 150° C. for 15 to 450 seconds, and more preferably for 15 to 300 seconds; at 170° C. for 5 to 450 seconds, and more preferably for 5 to 300 seconds; at 200° C. for 4 to 100 seconds and more preferably for 2 to 50 seconds. According to our empirical findings, at a temperature lower than a certain level, no great increase is achieved in the strength of the toner image even after prolonged heating, and the temperature is desirably at least 120° C., more desirably at least 150° C.

The circumstances under which a desired heating condition substantially common to various formulations of the photosensitive material and toner can be defined may be described as follows. A binder suitable for a given photosensitivve layer must have a proper second-order transition point in consideration of the mechanical strength of the layer as well as antiblocking or curling property and this requirement is reflected in the common characteristics of having a softening point of from 50° to 80° C. On the other hand, if the resin to be used as toner particles is excessively soft (low in cohesion of individual toner particles in the toner layer), its molecular chain is too long and has a tendency to cause secondary agglomeration of toner particles in the liquid carrier. For this reason, every resin to be selected has a suitable second-order transition point capable of providing satisfactory cohesion between particles inside the toner layer.

Therefore, if a photosensitive material having a toner image formed thereon is heated to a low temperature of not higher than 80° C. to let the liquid carrier evaporate, satisfactory cohesion between toner particles will not take place whatever formulation is used for the photosensitive material or toner, and it seems that only after heating to higher than 120° C. can a rapid extension of press-life be realized.

It is to be understood that FIG. 2 represents only the results obtained by the simplest heating method, and that many other examples of heating conditions are easily conceivable as will be described hereinafter. Unlike the image comprising a crosslinked organic polymer as obtained by the traditional photochemical reaction, the image contemplated by the method of this invention consists essentially of a mass of very fine particles, and hence, the absolute value of temperature is intricately correlated with the heating period, and the correlation defines simplified description.

Figure 3:
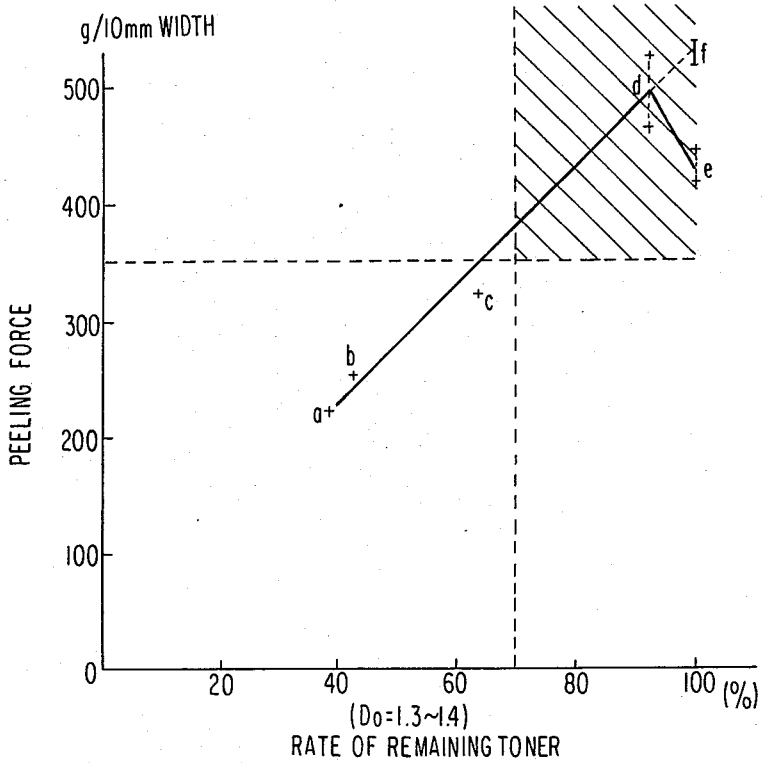
FIG. 3 is a graph showing one result of the experiment to be conducted in this invention.

The cohesion of particles inside the toner layer can be simply described by the required peeling force if the break plane is inside the toner layer, but if such cohesion becomes greater than the bonding strength between the tape and toner layer (Fs), peeling will occur at the interface of the tape and toner layer. This phenomenon can be better understood by reference to FIG. 3. The figure shows the results of a tape peeling test conducted on the solid black area (having 0.06 mg of toner particles deposited per square centimeter and exhibiting a reflection optical density of 1.3 to 1.4) of a toner image obtained by a method in substantial accord with Example 1 to be described hereunder; the horizontal axis represents the residual toner calculated from the change in optical density after peeling (in the solid black area, the density is in substantial proportion to the toner deposit), and the vertical axis represents the peeling force required. The test conditions employed were the same as defined in SUMMARY OF THE INVENTION, and all measurements were made in a room having a temperature of from 20° to 25° C. and a relative humidity of 50 to 65%. In FIG. 3, point a represents the value for a printing plate prepared by drying a master with hot air (50° C.) and leaving it to stand at room temperature for more than a week (as in the conventional technique). Its press-life was such that it could provide 500 to 700 reproductions before the image area was impaired. Point b represents the results obtained by heating the master of a at 60° C. for 5 minutes, and not a bit of improvement was achieved in the press-life. Point c represents the results from heating the same master at 90° C. for 5 minutes, wherein the press-life was extended to provide about 1,000 reproductions. Point d corresponds to heating at 120° C. for 5 minutes that provided a printing plate of very long press-life (well over 3,000 reproductions) with an image area extremely highly resistant to damage. Point e (with some degree of scatter) represents a toner residue of 100% which can be realized by heating at 150° C. for 5 minutes or longer. The printing plate obtained had a press-life of from 6,000 to a maximum of 30,000 reproductions. The upper limit was due merely to the expansion of the raw paper used, and it is obvious that a metal substrate or other strong support would provide a more durable printing plate.

At point e, the peeling force required is smaller than that for point d, but after closer observation of actual breaking, it can be concluded that the actual value of cohesion between particles inside the toner layer is near point f, and the apparent decrease is explained as follows. First of all, breaking does not occur parallel to the surface of the specimen because the toner layer comprises particles, and the break plane has a motleyed pattern with varying depths of color. Therefore, (1) the actual broken area might be larger than what would be imagined from the tape width and it is believed that such difference becomes negligible when peeling occurs at the interface of the tape and toner layer; and (2) as soon as a residual toner of 100% is reached, the surface of the toner image may have experienced a certain change in its quality.

In any event, we have measured or estimated the cohesion of toner particles inside the toner layer on the basis of the series of experiments the results of which are represented in FIG. 3, and have found that a remarkable improvement in press-life is achieved when the measured or estimated value exceeds the certain value specified above. In other words, the above tests generally simulate the physical action under which the toner image will be placed during lithographic operation, and the central feature of this invention is to realize such desired condition by the simple means of heating. It is empirically known in the art of PS plates that in the printing operation for providing up to 20,000 to 30,000 reproductions, the strength determined by an image strength test with an adhesive tape is closely correlated with the press-life, but here let us make a supplementary remark on the peeling test with an adhesive tape. To begin with, incomplete bonding of a ZnO photosensitive layer to a support having a waterproof layer can cause the peeling of the photosensitive layer from the waterproof layer of the support during a tape test even when the photosensitive material has yet to go through a heat treatment. In a like manner, the incomplete bonding between the two layers is a limiting factor to the press-life of the printing plate prepared from such photosensitive material. Therefore, it should be understood that the method of this invention presupposes the absence of the kind of peeling that occurs in the photosensitive material at the interface of the ZnO photosensitive layer and the support.

The method of heating is limited in many ways if paper is used as a substrate. A general support comprises a paper base coated with a waterproof subbing layer and, in most cases, with a waterproof backing layer. This construction is believed to provide the most economical support in view of the need of rendering it electrically conductive. When an electrophotographic photosensitive material containing such support is heated, air contained in the porous structure of the paper or a vaporizing component such as the volatile liquid carrier swells rapidly to cause "blisters". Therefore, care need be taken to avoid blistering when the method of this invention is applied to an electrophotographic photosensitive material using a support of the type described above. Generally speaking, a material susceptible to blistering has a porous structure, e.g., paper, and has a gas permeability rate higher than 10,000 seconds measured by JIS P8227-1963 (defined by time necessary for 100 ml gas to pass through a material of 645.16 $mm^2$). Such material generally has its temperature elevated at a rate higher than 60° C./second, and if heating continues for a period of 2 to 3 seconds, blistering results. The toner contains a measurable amount of carbon black and absorbs infrared rays effectively; hence, blisters are likely to form in the solid image area even if the heating means is that of radiation heating. Blistering is less likely to develop if the photosensitive material is heated directly by passing through heated pressure rollers having a releasable surface, but then, a light-faced character will be defaced in a congested area or a dirty roll surface may cause the offset of an image. For this reason, the use of heated pressure rollers is not considered the best method of heating.

Most desirably, the photosensitive material is first heated to about 120° C. at a temperature elevation rate lower than the stated level, and after the expanded gas has been removed from its surface, the material is held under the intended heating conditions. The preheating can be accomplished by directing the photosensitive material onto a hot plate in contact with its reverse face, and subsequently, it may be exposed to radiation from the sources of radiation heating arranged along a transport passageway. Alternatively, the introduction of the photosensitive material into an oven held at higher than 120° C. will assure good results.

Yet another desired method uses a wire mesh or screen interposed between the sources of radiation heating and the photosensitive material; according to this method, at some moment the temperature of only the area facing an opening in the wire or screen is elevated, and in this way the pressure from the expanding gas is reasonably reduced, because it is absorbed by the photosensitive material in the transversal direction. If a high energy strobe light is used as a heating source, the photosensitive material can be heated uniformly throughout the surface without causing blistering, by lighting the strobe in synchronism with the time when an unheated region of the running photosensitive material is positioned beneath an opening.

Following the heat treatment, the background region of the photosensitive material is subjected to hydrophilic-conversion which is performed with a processing solution containing at least one compound of a water-soluble ferrocyanide compound, ferricyanide compound or phosphorus compound. Preferred processing solutions and methods for use in this invention are described in the following patents: U.S. Pat. No. 2,988,988, Japanese Patent Application (OPI) No. 101102/77, U.S. Pat. Nos. 4,043,811, 3,714,891, Japanese Patent Publication No. 21244/71, British Pat. No. 1,321,380, Japanese Patent Applications (OPI) Nos. 63101/78, 101102/77, U.S. Pat. Nos. 3,445,224, 3,323,451, 2,957,765, 3,107,169, British Patent No. 1,198,122, Japanese Patent Publications Nos. 16946/62, 28408/68, 9045/69 U.S. Pat. No. 3,672,885, and British Pat. No. 1,259,555.

The desensitizing solution is generally prepared in such a manner that it contains from about 1 to 10 wt % of an ingredient capable of rendering the surface of the photosensitive layer hydrophilic. Such solution may be applied to the photosensitive layer with a cotton pad, or the photosensitive material may simply be immersed in the solution. As was previously noted, the background region of the printing plate is kept etched during printing operation. For this purpose, a 4- to 10-fold dilution of the desensitizing solution described above is continuously supplied to the plate as damping water.

The press-life of a printing plate is evaluated in this invention based on the following criterion. Under controlled exposure and development conditions for plate-making operation, a reflex original of a 9-degree Ming-style type for photocomposition is reproduced on a photosensitive material by close-up photography at natural size. At the start of printing, the horizontal lines of the type are reproduced without forming any interrupted portion (see FIG. 4*a*, magnification 40x). Each of the horizontal lines is generally 60 microns wide. When printing is continued under the standard printing conditions specified just below using damping water having small etching effect, the press-life of the plate can be known by the formation of about 10 interrupted portions in 5 mm of a line that are clearly discernible under observation at a magnification about 40x.

Figure 4A:
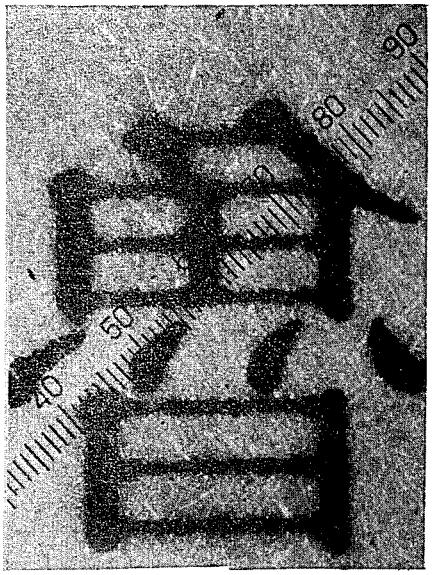
FIGS. 4A, B and C is a set of pictures that show the images reproduced upon repeating the printing operation in predetermined numbers using a printing plate prepared by a conventional electrophotographic process.
Figure 4B:
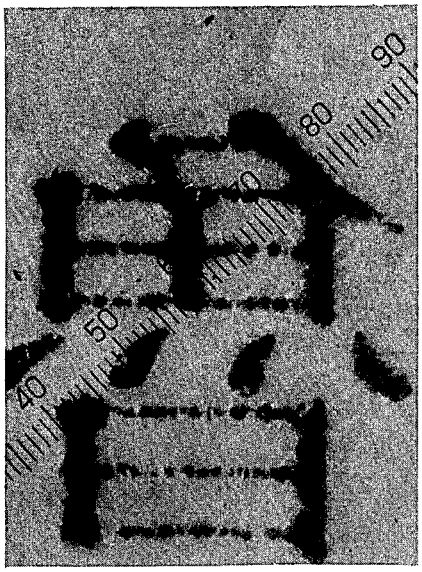
Figure 4C:
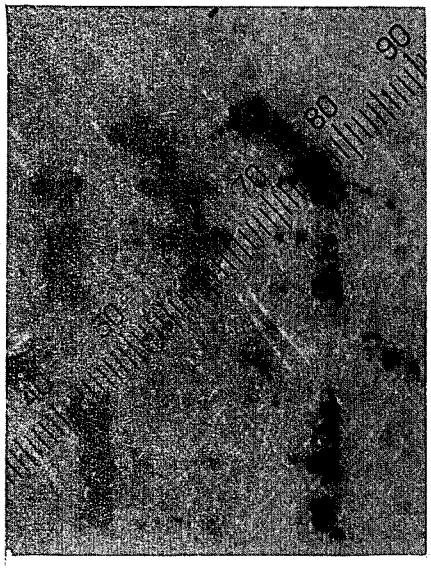
Figure 5A:
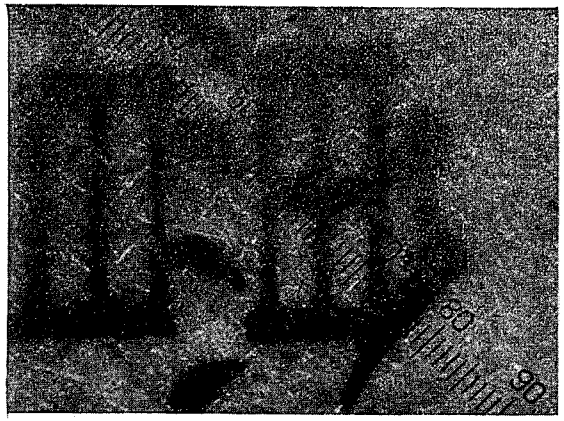
FIGS. 5A, B and C is a set of pictures that show the images reproduced upon repeating the printing operation using a printing plate prepared by the process according to this invention.
Figure 5B:
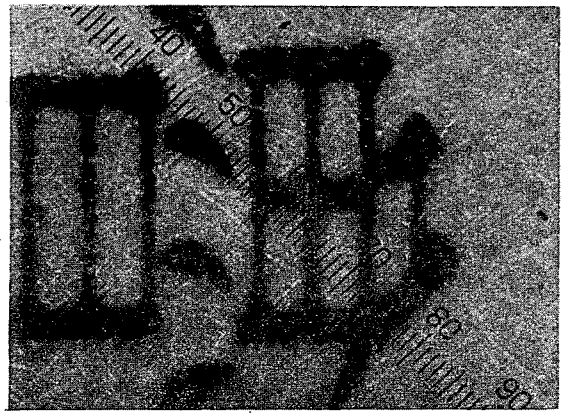
Figure 5C:
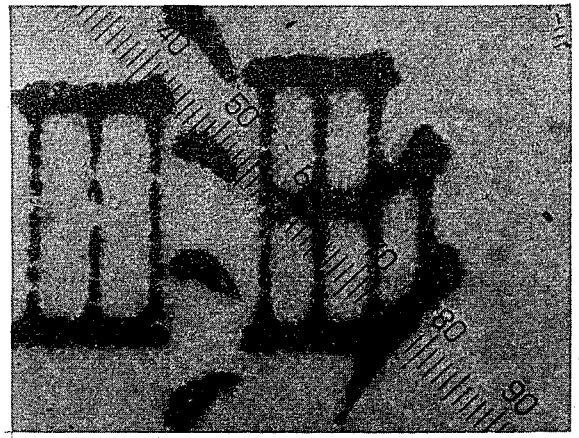

Generally, in the conventional master wherein the cohesion of toner particles inside the toner layer is about 220 g/10 mm (width), interruption of horizontal lines occurs right after the start of printing and it continues to thereby provide defective reproductions two of which are represented in FIGS. 4*b* and 4*c*. FIG. 4*a* represents the 150th reproduction, and 4*b*, the 1,250th reproduction that indicate that the useful press-life of the plate had ceased. FIG. 5 shows illustrative reproductions obtained from a master identical with what is illustrated in FIG. 4 except that it was heated at 150° C. for 5 minutes before hydrophilic-conversion; FIG. 5*a* represents the 150th reproduction, FIG. 5*b*, the 5,000th reproduction, and 5*c*, the 8,000 reproduction. The master has an estimated press-life between 6,000 and 6,500 reproductions.

The standard printing conditions used are as follows.

Hydrophilic-conversion: An etching solution comprising Elefax (sold by Iwatsu Electric Co., Ltd.) is absorbed in cotton and applied by hand to the plate. After a 1-minute standing, reapply the same solution and let it stand.

Printing machine: Hamada-Star 600 CD

Printing ink: New Champion Super HG Indian ink (manufactured by Dainippon Ink & Petrochemicals Inc.)

Damping water: An 8-fold aqueous dilution of Elefax etching solution

Printing Pressure: Plate cylinder/blanket, or blanket-/impression cylinder, both type adjusted to provide an ink width of 4 mm Printing speed: 5,000 to 7,000 reproductions/hr Ink density: 1.3 to 1.4 solid steps on printed matter Printing paper: 55 kg of wood-free paper The following advantages are obtained from the method of this invention:

(i) With increased image strength, a low image density does not prevent the provision of a number of reproductions. This means a greater latitude in exposure and development conditions.

(ii) According to the conventional technique, if damping water of great etching effect is used, a stain is less likely to form in the background but then the press-life is sacrified. On the other hand, this invention permits the use of damping water having greater etching effect than has been possible with the conventional master. Hence, there is also a greater latitude in printing conditions.

(iii) The image quality of a reproduction obtained in the first period of printing is maintained up to the time close to the end of the printing.

(iv) Improved reproduction of thin lines and halftone image is achieved.

(v) The longer press-life does not mean much if it is not accompanied by an improved image quality or if extended storage of the plate is impossible. But in this respect, an electrophotographic system has an adequately great potential for providing a satisfactory good image quality and extended plate storage. Therefore, the plate prepared by this invention can be used advantageously in the fields where PS plates and silver salt plates have found much utility.

(vi) Because of advantage (v), printers do not have to install printing systems operating on different principles. This means that efficient management of print shops can be easily realized.

This invention is now described in greater detail by reference to the following examples which are given here for illustrative purposes only and are by no means intended to limit the scope of the invention.

EXAMPLE 1

To a mixture of 100 parts by weight of photoconductive ZnO (the French process) and 62.5 parts by weight of acrylic copolymer varnish LR-009 (manufactured by Mitsubishi Rayon Company Limited and containing 40 wt % of non-volatiles), toluene was added and kneaded in a ball mill until the mixture was free from coarse aggregates. To the mixture, methanol containing 150 mg of Rose Bengale, 80 mg of fluorescein, and 80 mg of food blue dye No. 1 per 100 g of ZnO was added to form a coating solution.

A support was prepared by the method of Example 1 of Japanese Patent Publication No. 11898/73. The coating solution was applied to the surface of the interlayer of the support to form a coating in a dry thickness of 10 microns, and the so treated support was dried at 120° C. for 2 minutes to provide a photosensitive material. The material was charged negatively, exposed from a positive image, and processed with a developer to provide a positive image. The developer was prepared by the following method. A mixture comprising equal weights of cryclized rubber and lauryl methacrylate as copolymerized using 2,2'-azobisisobutyronitrile (ABIN): 30 parts
Reaction product of Nigrosine abietate and oleic acid: 10 parts
Carbon black: 10 parts
Solvesso 150 (aromatic hydrocarbon manufactured by Esso Standard Oil): 20 parts A mixture of the above formulation was thoroughly kneaded in a triple roll mill. After addition of an equal volume of Isopar H, the mixture was kneaded in a ball mill for 10 hours. The resulting paste (ca. 2 g) was dispersed in 2 liters of Isopar H to form a developer. The toner in the developer had a positive charge and provided a positive image.

The formulation above contained 40 parts by weight of the filmforming thermoplastic component per 10 parts by weight (5 parts by volume assuming a specific gravity of 2) of the pigment component (carbon black), but an electrodeposited toner layer contained less than 0.1 parts by weight (ca. 0.1 parts by volume) of a thermoplastic component, at the most of which dissolved into the liquid carrier and did not participate in image formation.

The thus-formed image was held at 60° C. for minutes for drying. Subsequently, it was treated with a hydrophilically converting solution of the following composition which was adjusted to a pH of 5.0 with citric acid.

Potassium ferrocyanide: 5 g
L-Glutamic acid: 10 g
Monoammonium phosphate: 10 g
Diammonium phosphate: 10 g
Water: 500 ml The so treated plate was set in a printing machine for lithographic operation during which an 8-fold dilution of the above solution was supplied as damping water. The plate had a press-life of about 500 reproductions. When the number of reproductions exceeded 700 to 800, the occurrence of many interruptions in horizontal lines of the image was noticeable.

Another printing plate was prepared by the same procedure as above except that before the hydrophilic-conversion, it was subjected to a heat treatment consisting of a preliminary heating at 120° C. for 10 seconds and main heating at 150° C. for 25 minutes. The treated plate had a press-life of 15,000 reproductions. It even withstood printing for 30,000 reproductions, except that a crack developed in the photosensitive layer due to the expansion of the paper substrate.

The cohesion of particles inside the toner layer of each plate sample was measured by the method described herein. The sample dried at 60° C. had a residual toner after peeling of 40 to 45%, and the peeling force required was 250 g/10 mm wide portion. The sample heated at 150° C. had a residual toner of 100%, and for the same reason as given in the description with reference to FIG. 3, the cohesion of particles inside the toner layer was estimated at 450 g/10 mm wide portion or more.

EXAMPLE 2

A photoconductive ZnO layer having a dry thickness of 8 to 9 microns was formed on a waterproof paper support identified by the symbol C in Example 1 of Japanese Patent Publication No. 9608/70. The photoconductive layer was prepared from a material made by the method of Example 1 of Japanese Patent Publication No. 31011/75.

After thorough dark adaptation, a static latent image of negative polarity was formed on the photosensitive layer by a conventional technique, and the image was processed by a liquid developer prepared by the method of Example 18 of Japanese Patent Application (OPI) No. 75440/75.

The developed material was subjected to various conditions of heating indicated in Table 1 below, and then desensitized in the same manner as in Example 1. The data on the press-life, residual toner and cohesion of particles inside the toner layer as determined by the method described herein are also set forth in Table 1.

TABLE 1

| Heating conditions | Residual toner | Internal cohesion (g/10 mm wide) | Press-life (No. of reproductions) |
|---|---|---|---|
| standing at ordinary temp. | 30–35% | 190 | 500 |
| 70° C., 1 hr | 45% | 240 | 500 |
| 100° C., 20 min | 50–55% | 300 | 750 |
| 120° C., 10 min | 70% | 350 | 2000 |
| 150° C., 5 min | 90% | 430 | 5000 |
| 170° C., 5 min | 100% | >400 | 7000 |

EXAMPLE 3

Raw paper (basis weight: 150 g/m$^2$) treated with a melamine resin to provide increased wet strength was coated on one side with a photoconductive layer comprising 20 parts by weight of carbon black and 50 parts by weight of an aqueous emulsion of a methyl methacrylate/butadiene (40:60 in molar ratio) copolymer (non-volatile content of 50%). The coating weight was 5 g/m$^2$ on a dry basis. The other side of the paper was also coated with a waterproof film identical with what was used in sample A of Example 1 of Japanese Patent Publication No. 9608/70.

The photoconductive layer was overlaid with a 10 μ-thick photosensitive layer the same as prepared in Example 1. The thus prepared photosensitive material was processed with a liquid developer that was made by kneading the following composition in Isopar H:

Copolymer obtained by reacting 7 parts by weight of cyclized rubber with 3 parts by weight of 2-ethylhexyl methacrylate: 25 parts Graft carbon obtained by polymerizing a mixture of 95 parts by weight of lauryl methacrylate and 5 parts by weight of acrylic acid in the presence of carbon black (polymer chain weight: carbon weight=50:50): 10 parts The resin content of the supernatant obtained by electrodeposition of the developer indicated that the developer produced an image that contained about 10 parts by weight of resin per 10 parts by weight of the pigment component (carbon in the graft carbon). When the image was subjected to heating and subsequent steps under the same conditions as used in Example 1, the results were the same as obtained in Example 1.

EXAMPLE 4

The raw paper of Example 3 was provided with a μ-thick (dry basis) coating of a ZnO photosensitive layer the same as described in Example 1 of Japanese Patent Application (OPI) No. 8557/73. A liquid developer was prepared by the following method.

Graft carbon (having a composition the same as identified in Example 4 of Japanese Patent Publication No. 5945/76): 20 parts by wt.

Cyclized rubber: 15 parts by wt.

Solvesso 150: 45 parts by wt.

A mixture of the above composition was kneaded thoroughly in a porcelain ball mill, and the resulting paste (2 g) was dispersed in about 2 liters of Isopar H.

The toner deposited on the image area contained about 1.1 parts by weight of the resin component (polymer chain in the graft carbon and cyclized rubber) per part by weight of carbon. Again, the image was given a remarkable increase in press-life by heating to a temperature of 120° C. or higher. The change in the cohesion of particles in the toner layer followed a path almost agreeing with the curve shown in the graph of FIG. 1.

EXAMPLE 5

The procedure of Example 4 was repeated using a support comprising Elefax Master-APR-1 (Iwatsu Electric Co., Ltd.) freed of a ZnO photosensitive layer through dissolution. The photosensitive paper obtained had a gas premeability rate of at least 10,000 seconds as measured by the method of JIS P8117. Blisters formed all over the surface of the paper when it was pressed against a hot plate heated to 170° C. However, when the paper was pressed against that hot plate after it was held in slight contact with a hot plate (120° C.) for about 10 seconds, no blister was formed.

EXAMPLE 6

The procedure of Example 1 was repeated except that a developer the same as described in Example 2 of Japanese Patent Publication No. 25666/73 was used. The results were almost the same as obtained in Example 1.

EXAMPLE 7

The procedure of Example 3 was repeated using a photoconductive layer of the following composition, and the results were almost the same as obtained in Example 3.

ZnO: 80 parts by wt.

Kaolin clay: 20 parts by wt.

Linear polyester resin (Byron 20, Toyobo Co., Ltd.): 25 parts by wt.

Rose Bengale: 0.05 parts by wt.

EXAMPLE 8

An aluminum substrate with a brush-abraded surface was subbed with 5 to 7 g/m$^2$ of a layer comprising 100 parts by weight of photoconductive ZnO and 40 parts by weight of a soybean oil-modified epoxy ester resin (oil length: 50%), and heated at 80° C. in air overnight to cause partial hardening of the resin. The subbing layer was overlaid with a layer comprising 100 parts by weight of photoconductive ZnO, 20 parts by weight of an acrylic resin the same as described in Example 1 of Japanese Patent Application (OPI) No. 8557/73 (copolymerized monomers being methyl methacrylate, n-butyl methacrylate, dimethyl aminoethyl methacrylate and

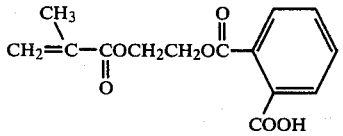

and 0.05 parts by weight of Rose Bengale. The coating weight was 22 g/m$^2$ on a dry basis.

The resulting photosensitive material was processed with a liquid developer the same as used in Example 1. The image-bearing material was heated at 160° C. for 10 minutes followed by hydrophilic-conversion in the same manner as in Example 1. The resultant master had a press-life of 50,000 reproductions.

In Examples 1 thus 8, the surface of the photoconductive layer was finished to such a degree of smoothness that it contained in an area of square contimeter not more than 10 protrusions larger than 40 microns in size.

EXAMPLE 9

The photosensitive material of Example 8 was charged negatively and imagewise exposed through a negative microfilm original. A mixture comprising 40 parts by weight of carbon black and 200 parts by weight of a polyester resin (XPL 2005, Kao-Atlas Company Limited) was thoroughly kneaded in a roll mill, and the resulting cake was charged into a ball mill together with 350 parts by weight of Isopar H and ball-milled for 15 hours to provide a dispersion. Separately from the dispersion, 30 parts by weight of a styrene/butadiene block copolymer (Solbrene 1205, Asahi Chemical Industry Co., Ltd.) was dissolved in 120 parts by weight of Isopar H, and heated at 170° C. for 15 minutes to obtain a viscous product. A mixture of the product and the previously prepared dispersion was ball-milled for an additional 40 hours to form a concentrated toner.

To a dispersion of 30 ml of the concentrate in 1000 ml of Isopar H, 20 mg of lecithin was added as a polarity regulator. When the resulting developer of negative polarity was used to process the photosensitive material, a positive-image bearing plate was produced. The plate was then heated at 180° C. for 20 seconds, and subjected to hydrophilic-conversion and printing in the same manner as in Example 1. The plate could provide 5,000 reproductions without any trace of deteriorated image quality.

While the invention has been described in detail and with reference to specific embodiments thereof, it will be apparent to one skilled in the art that various changes and modifications can be made therein without departing from the spirit and scope thereof.

What is claimed is:

1. A process for preparing a lithographic printing plate from an electrophotographic photosensitive material comprising a photoconductive insulating layer containing photoconductive zinc oxide and a thermoplastic insulating resin wherein the ratio of ZnO: binder resin is from about 3:1 to 20:1 disposed on a waterproof support, said process comprising the steps of electrical charging, imagewise exposure, and development of the material in a wet developer having toner particles containing an oleophilic component dispersed in an insulating liquid carrier, thereby providing an oleophilic toner image directly on said photoconductive insulating layer and heating the developed photosensitive material at 120° C. or more such that when an adhesive tape having a tackiness of 280 to 350 g/10 mm wide portion as measured by the 180° peeling method of JIS C2107 (passed once between pressure rollers at 50 mm/sec) and which has been contact-bonded to the surface of said toner image-bearing photosensitive material by passage between a metal roll and a rubber roll pressed against said roll at a pressure of 6000 g/cm$^2$, is peeled off said photosensitive material one minute after the contact-bonding at a peeling rate of 500 mm/min and an angle of 180 degrees, the toner image carried away by adhering to the tape is not more than 30 wt. % of the toner in the solid image area on which at least 0.03 mg/cm$^2$ of the toner is deposited, and the cohesion of toner particles inside the toner layer against the peeling force is at least about 350 g/10 mm wide portion.

2. A process according to claim 1 wherein the photoconductive insulating layer contains at least 8 wt. % of a thermoplastic resin binder capable of fully softening at a temperature higher than 100° to 120° C.

3. A process according to claim 1 wherein the waterproof support comprises a waterproof layer on the opposite side thereof from the side on which the photosensitive layer is provided.

4. A process according to claim 1 wherein the surface of the photoconductive insulating layer contains in an area of one square centimeter not more than 50 protrusions larger than 40 microns in diameter.

5. A process according to claim 1 wherein the photosensitive material bearing the toner image is heated under a condition either within or equivalent to the range identified by A in accompanying FIG. 2.

6. A process according to claim 1 wherein the photosensitive material has a gas permeability rate lower than 10,000 seconds as measured by the method of JIS P8117 and the material is heated under a condition that allows the gaseous component inside the material to be released therefrom without causing blistering therein.

7. A process according to claim 6 wherein the heat treatment for the material consists of (1) a preliminary heating step that allows the gaseous component inside the material to be released therefrom without causing blistering, and (2) a subsequent main heating step carried out at a higher temperature.

8. A process according to claim 6 wherein the heating of the toner-image bearing photosensitive material has a distribution or a gradient in intensity along the lateral direction parallel to the surface of said material as to prevent blistering by allowing the gaseous component included in the material to expand along direction.

9. An electrophotographic photochemical process according to claim 1, wherein said resin has a second-order transition point of from about 10° to 80° C.

10. An electrophotographic photochemical process according to claim 1, wherein said resin has a second-order transition point of from 20° to 70° C.

11. An electrophotographic photochemical process according to claim 1, wherein said resin has a molecular weight of from several thousand to 50,000.

12. An electrophotographic photochemical process according to claim 1, wherein the ratio by weight of ZnO: binder resin is from 4:1 to 8:1.

13. An electrophotographic photochemical process according to claim 1, wherein the thickness of the photoconductive insulating layer is from about 5 to 20$\mu$.

14. An electrophotographic photochemical process according to claim 1, wherein the thickness of the photoconductive insulating layer is from about 6 to 12$\mu$.

15. An electrophotographic photochemical process as in claim 1, 2, 3, 4, 5, 6, 7, 8, 9, 10, 11, 12 or 15, wherein the toner image carried away by adhering to the tape is not more than 20 wt. % of the toner in the solid image area on which at least 0.03 mg/cm$^2$ of the toner is deposited.

16. An electrophotographic photochemical process according to claim 15, wherein the peeling force is at least 400 g/10 mm wide portion.

17. An electrophotographic photochemical process, as claimed in claim 1, wherein said developed photosensitive material is heated at a temperature of 150° C. or more.

18. An electrophotographic photchemical process, as claimed in claim 1, wherein said developed photosensitive material is treated with a dampening water after heating.

* * * * *